US007264532B2

(12) United States Patent
Chen

(10) Patent No.: US 7,264,532 B2
(45) Date of Patent: Sep. 4, 2007

(54) CUP STRUCTURE

(76) Inventor: Tsan-Yao Chen, PO Box 82-144, Taipei (TW)

( * ) Notice: Subject to any disclaimer, the term of this patent is extended or adjusted under 35 U.S.C. 154(b) by 102 days.

(21) Appl. No.: 11/020,361

(22) Filed: Dec. 27, 2004

(65) Prior Publication Data

US 2006/0138153 A1 Jun. 29, 2006

(51) Int. Cl.
*A63H 3/00* (2006.01)
*A63H 13/00* (2006.01)

(52) U.S. Cl. ..... 446/74; 446/200; 446/71

(58) Field of Classification Search ..... 446/74, 446/200

See application file for complete search history.

(56) References Cited

U.S. PATENT DOCUMENTS 2,544,594 A * 3/1951 Goldfarb ..... 446/74
3,285,584 A * 11/1966 Goldfarb ..... 446/74
3,834,068 A * 9/1974 Fabricant ..... 446/74
6,036,570 A * 3/2000 Nadel ..... 446/74

* cited by examiner

*Primary Examiner*—Eugene Kim
*Assistant Examiner*—Urszula Cegielnik
(74) *Attorney, Agent, or Firm*—Leong C. Lei

(57) ABSTRACT

A cup structure is disclosed. The cup structure having an external tube, a sealing cap, a suction tube and a cup body, characterized in that the sealing cap is a dual-layered body having a bottom seat for holding a rotating wheel and a through hole at the external edge thereof, corresponding to the upper layer seat of the seat, a connection tube having a through hole is provided so that the suction tube can be connected to the connection tube, the upper layer seat and the bottom layer seat are connected, and the face thereof is capped with a capping plate, and the core of a transmission mechanism within the upper layer seat is extended from the capping plate so as to connect to one or more than one decorating object, the upper layer seat is provided with a connection tube and an air tube corresponding to the top which is pivotally mounted with a triggering plate, a protruded tube is provided at one side of the triggering plate which can pass through the top capping plate and then is connected to the external tube.

1 Claim, 8 Drawing Sheets

CUP STRUCTURE

BACKGROUND OF THE INVENTION (a) Technical Field of the Invention

The present invention relates to cup structure, and in particular, to a cup which provides fin to the user, where decorative objects are mounted to the cup structure.

(b) Description of the Prior Art

Various types of cup structures which provide fun are available in the market. The first type has rotating wheel which is rotated when the user blows air into the cup. The second type has a transmission mechanism which can drive the decorative objects mounted to the cup body. The third type has a rotating wheel which can directly drive the packed decorating objects. The fourth type has a rotating wheel and a transmission inking mechanism which can drive the decorating objects. The drawbacks of these designs are that the cup has restricted function, and the body of the cup does not provide additional structural function. Accordingly, it is an object of the present invention to provide a cup structure which mitigates the above drawbacks.

SUMMARY OF THE INVENTION

The primary purpose of the present invention is to provide a cup structure having an external tube, a sealing cap, a suction tube and a cup body, characterized in that the sealing cap is a dual-layered body having a bottom seat for holding a rotating wheel and a through hole at the external edge thereof, corresponding to the upper layer seat of the seat, a connection tube having a through hole is provided so that the suction tube can be connected to the connection tube, the upper layer seat and the bottom layer seat are connected, and the face thereof is capped with a capping plate, and the core of a transmission mechanism within the upper layer seat is extended from the capping plate so as to connect to one or more than one decorating object, the upper layer seat is provided with a connection tube and an air tube corresponding to the top which is pivotally mounted with a triggering plate, a protruded tube is provided at one side of the triggering plate which can pass through the top capping plate and then is connected to the external tube.

Yet still another object of the present invention is to provide a cup structure, wherein the rotating wheel corresponding to the transmission mechanism is a light rotating wheel and the transmission mechanism is a light gears or transmission wheel.

Still a further object of the present invention is to provide a cup structure, wherein the rotating wheel is directly driven at the core so as to drive the decorating object extended from the cup body.

Yet still a further object of the present invention is to provide a cup structure, wherein the triggering plate is mounted within the laminated layer of the cap, and the rotating wheel is positioned at the bottom section of the cup body, and a layer of isolation isolates the cup body and the rotating wheel and a connection tube is extended to the top opening of the cup so as to blow or suck air so that the space of the isolated area provides convection air.

Still a further object of the present invention is to provide a cup structure, wherein the top portion and the middle section or the bottom section of the connection tube has a wider section so as to contain the decorating objection being driven by the rotating wheel.

Another object of the present invention is to provide a cup structure, wherein the rotating wheel at the bottom section of the cup body is capable of driving a transmission mechanism, so that the transmission mechanism rotates a protruded disc and at the same time drives the linking rod at the external isolation layer so that the decorating objects on the linking rod are rotated.

Other objects and advantages of the present invention can be more filly understood by reading the following detailed description of the preferred embodiments, with reference to the accompanying drawings.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
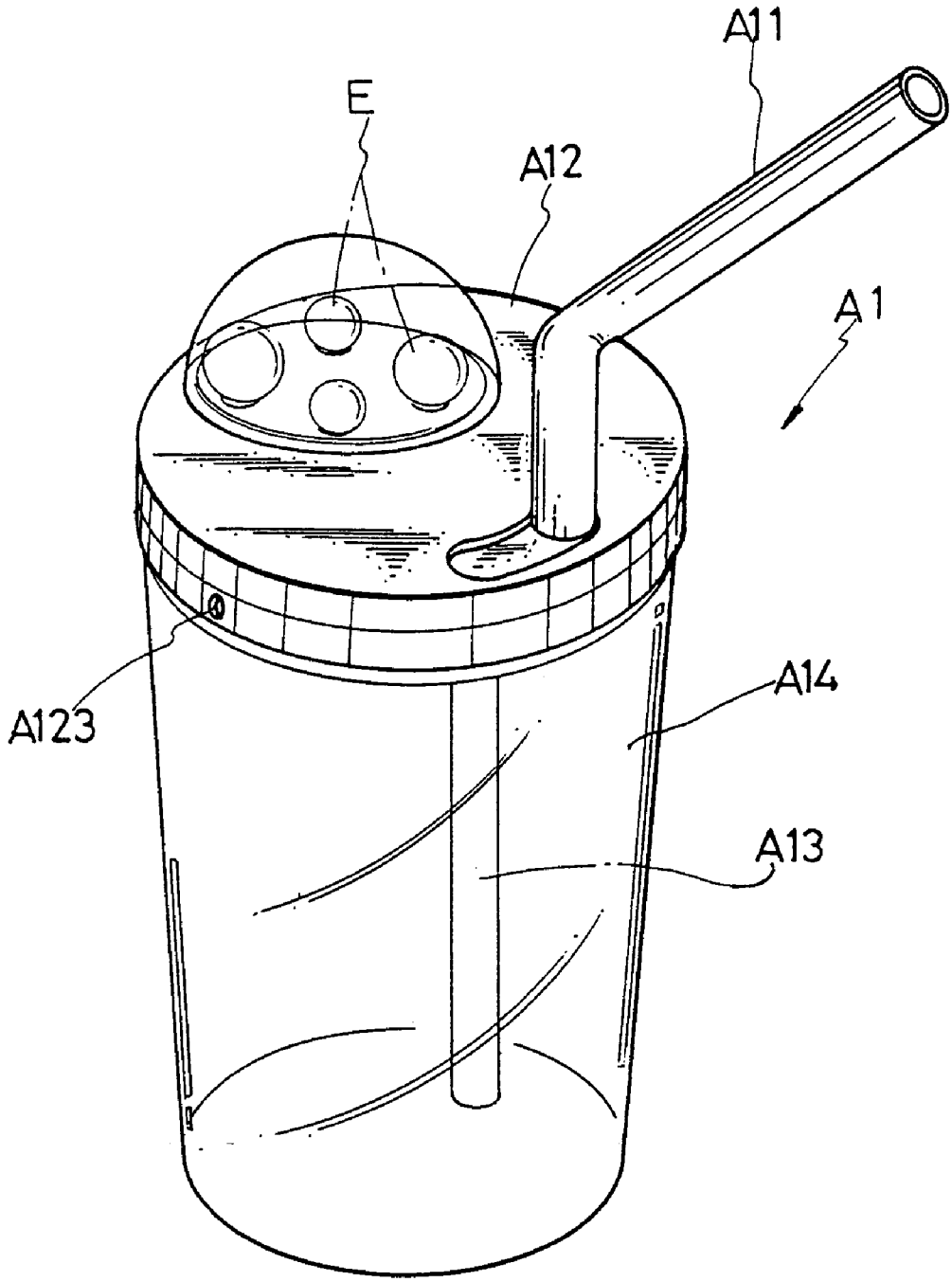
FIG. 1 is a perspective view of a preferred embodiment of the present invention.
Figure 2:
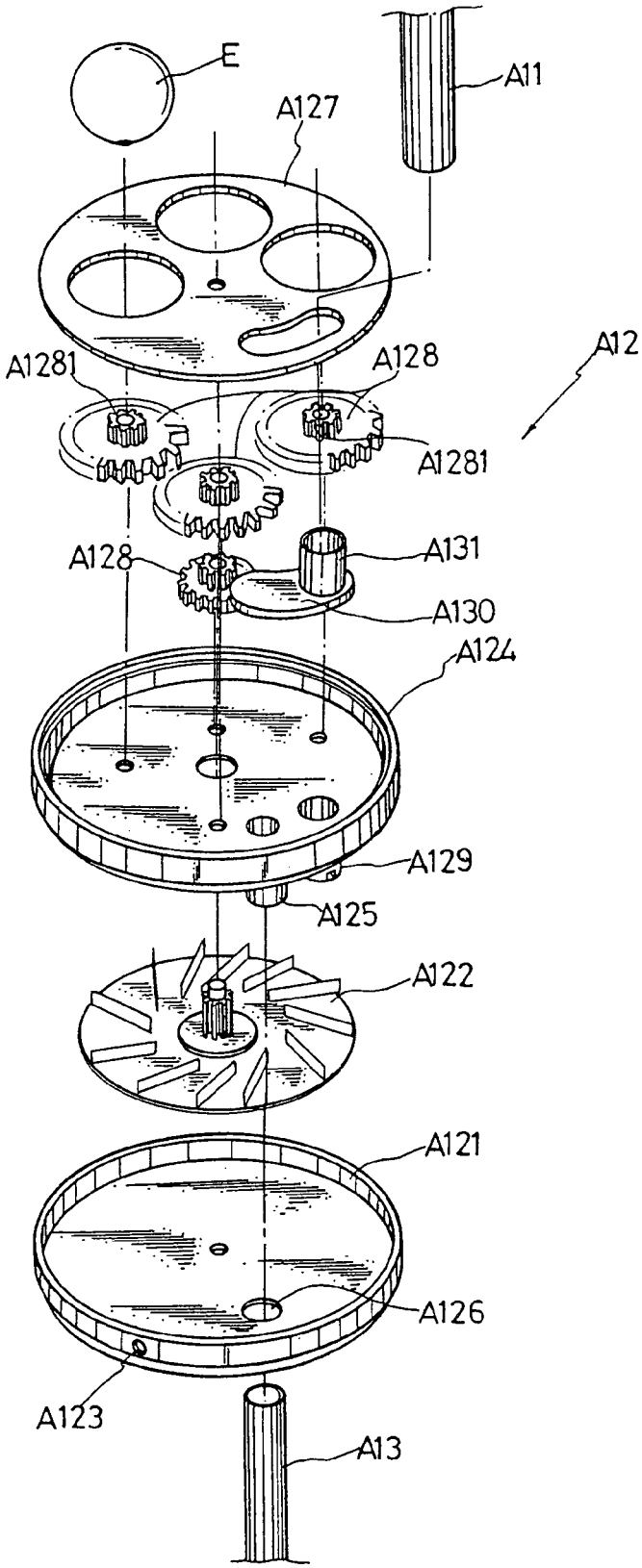
FIG. 2 is an exploded perspective view of the preferred embodiment of the present invention.
Figure 3:
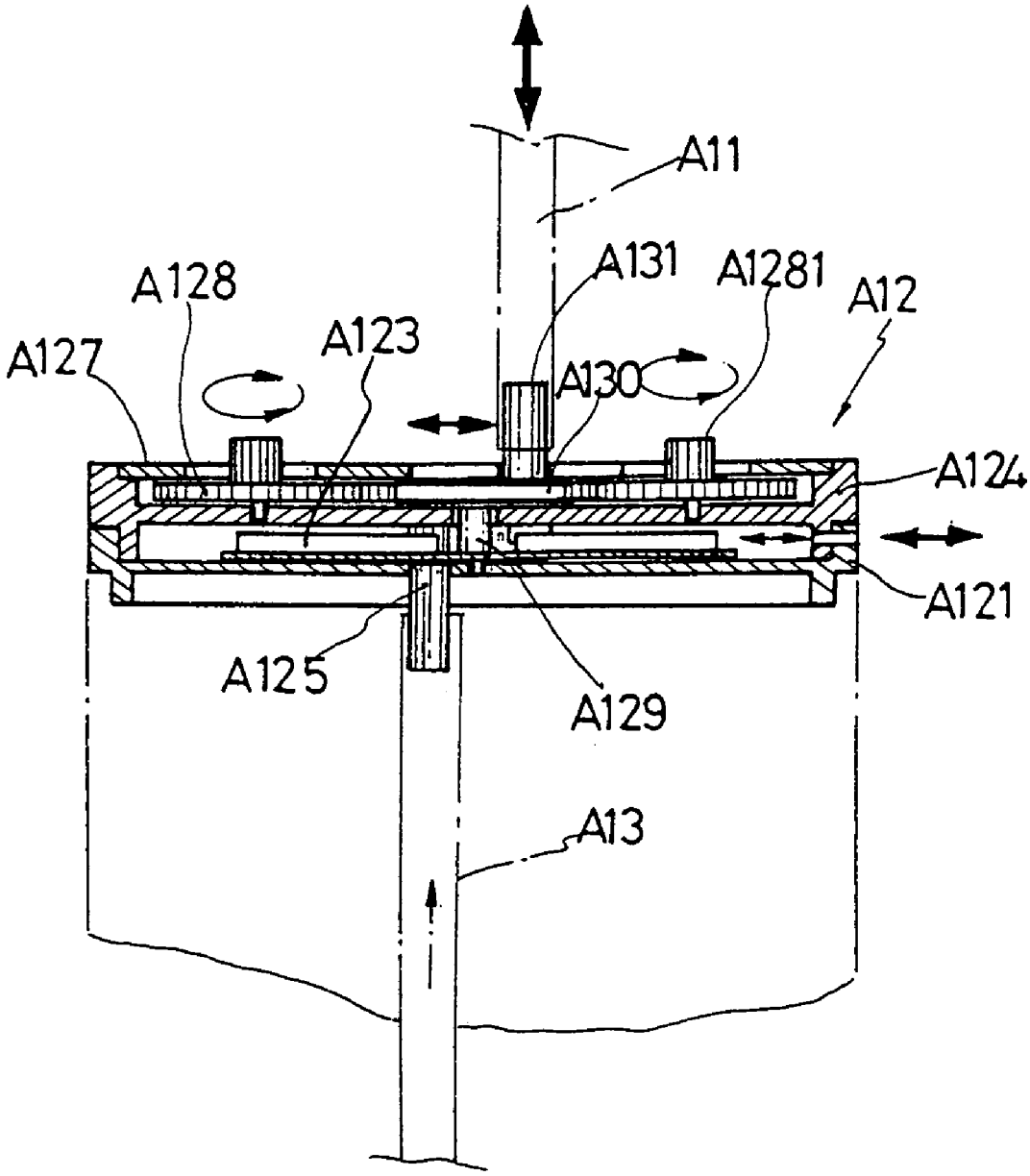
FIG. 3 is a sectional view of the cap of the cup of the preferred embodiment of the present invention.

Referring to FIGS. 1,2 and 3, there is shown a first preferred embodiment of the cup structure of the present invention A1. The structure comprises an external suction tube A11, a sealing cup cap A12, a suction tube A13 and a cup body A14. As shown in FIG. 2, the cup cap A12 is a dual-layered structure having a bottom layer seat A121 for holding a rotating wheel A122, and the external edge of the bottom layer seat A121 has a through hole A123 . A downwardly extending connection tube A125 is provided at the bottom of the upper layer seat A124 . A through hole A126 is provided to the bottom of the bottom layer seat A121 so that the suction tube A13 after passing through the through hole A126, can be connected to the connection tube A125. The upper layer seat 124 is connected to the bottom layer seat A121 and is capped using a capping plate A127. The axle A128l of the transmission mechanism A128 can be extended out from the capping plate A127 so as to connect with the ilecorating objects E. The transmission mechanism A128 is light gear transmission element which can drive the rotating wheel A122. This will rotate the decorating object E at the axle A1281. As shown in FIG. 3, the upper layer seat A124 has a connection tube A125 for water suction and an air tube A129. A triggering plate A130 is used for sealing. The triggering plate A130 is provided with an upwardly extending tube A131 which can pass through the capping plate A127 and is then connected with the external suction tube All.

In operation, the triggering plate A130 is actuated and the external tube A11 is positioned at the connection tube A125 or the air tube A129. If air is blown through the air tube A129, the bottom layer seat A121 forms with rapid air current so as to drive the rotating wheel A122 and the power is transferred to the transmission mechanism A128 so that the decorating objects E are driven.

Figure 4:
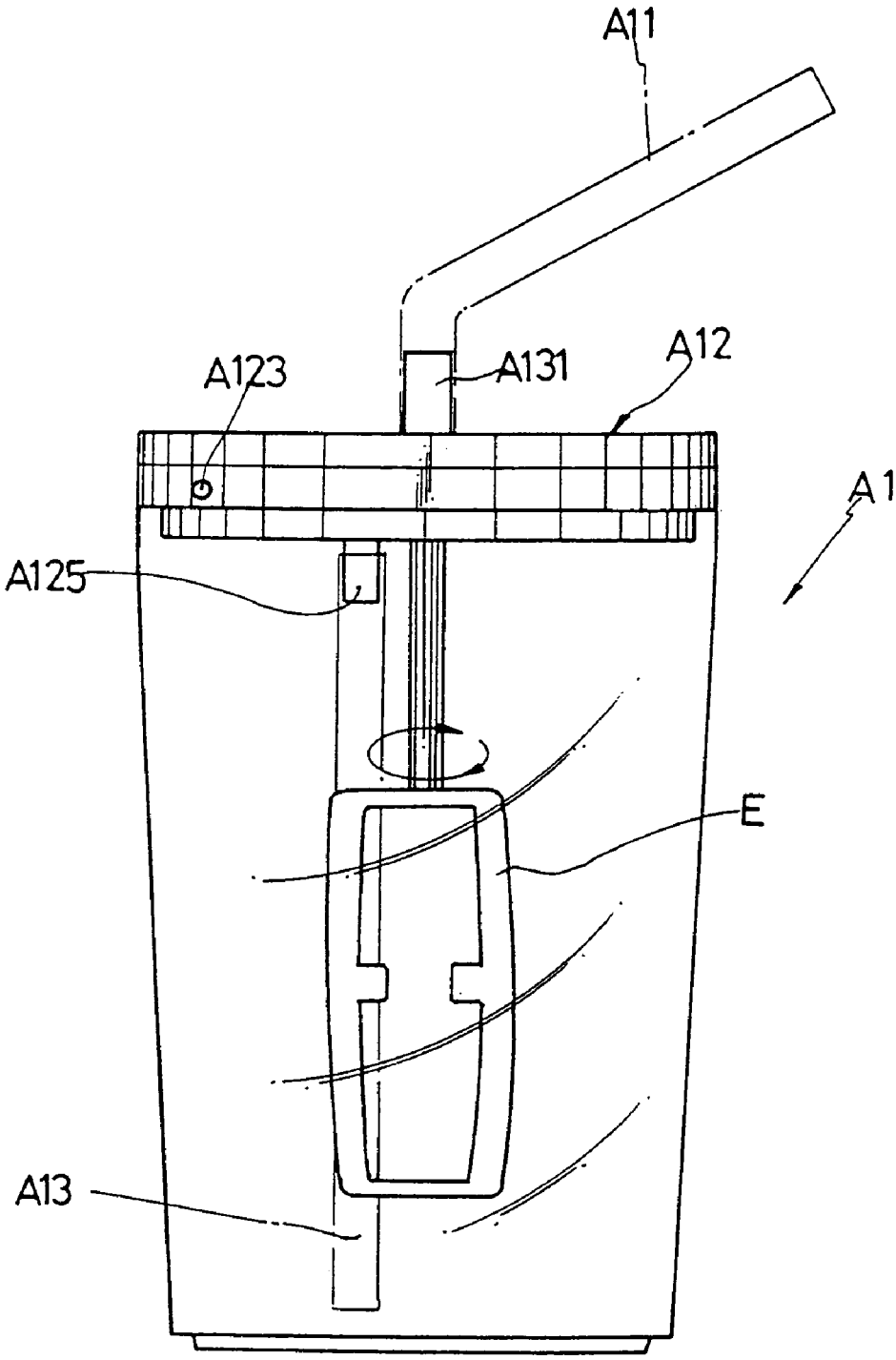
FIG. 4 is a schematic view showing a second preferred embodiment.
Figure 5:
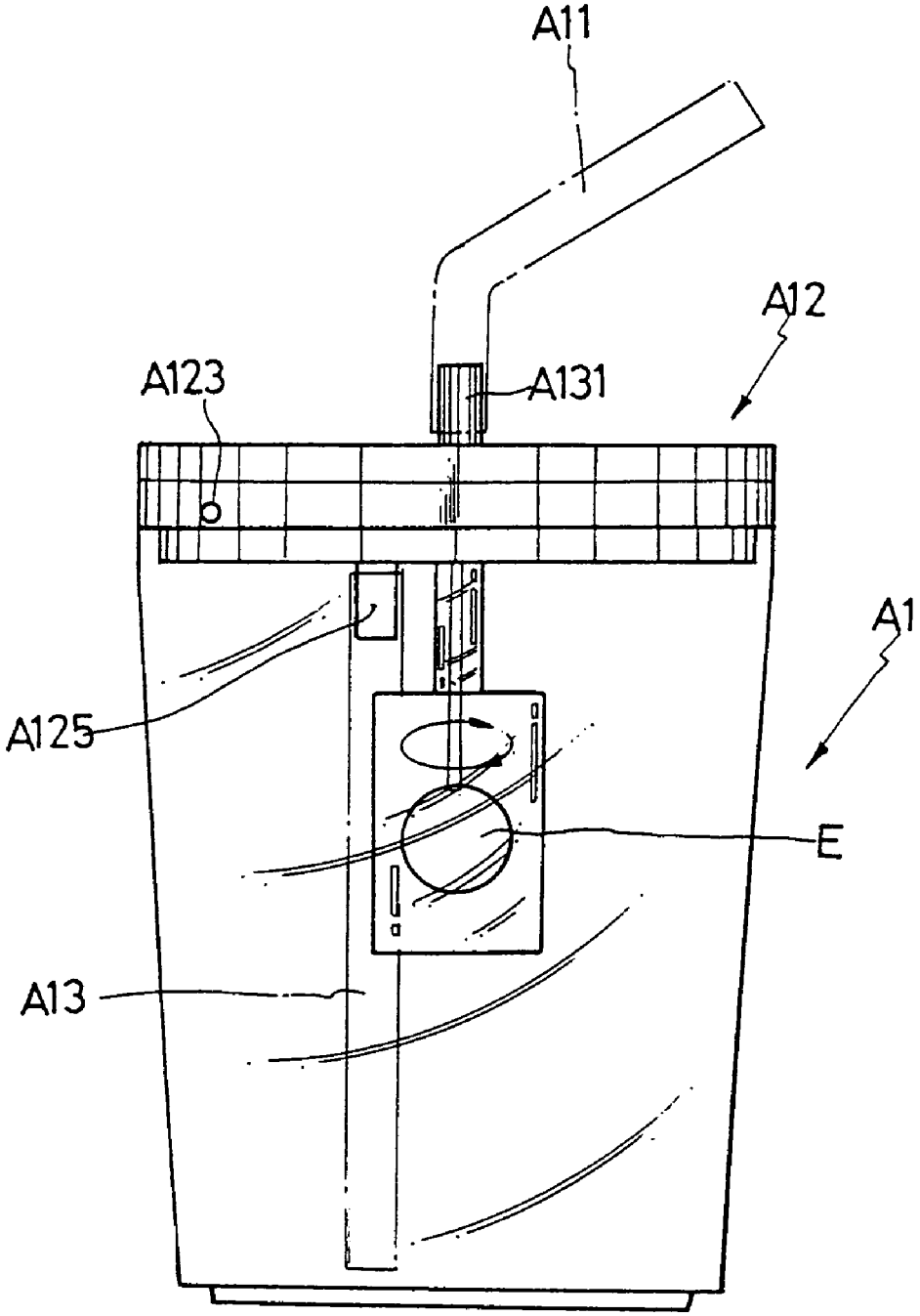
FIG. 5 is a schematic view showing the action of the second preferred embodiment.

Referring to FIGS. 4 and 5, there is shown a second preferred embodiment. The rotating wheel A122 drives the core so that the decorating objects E are driven. This will cause amusement to the cup A1.

Figure 6:
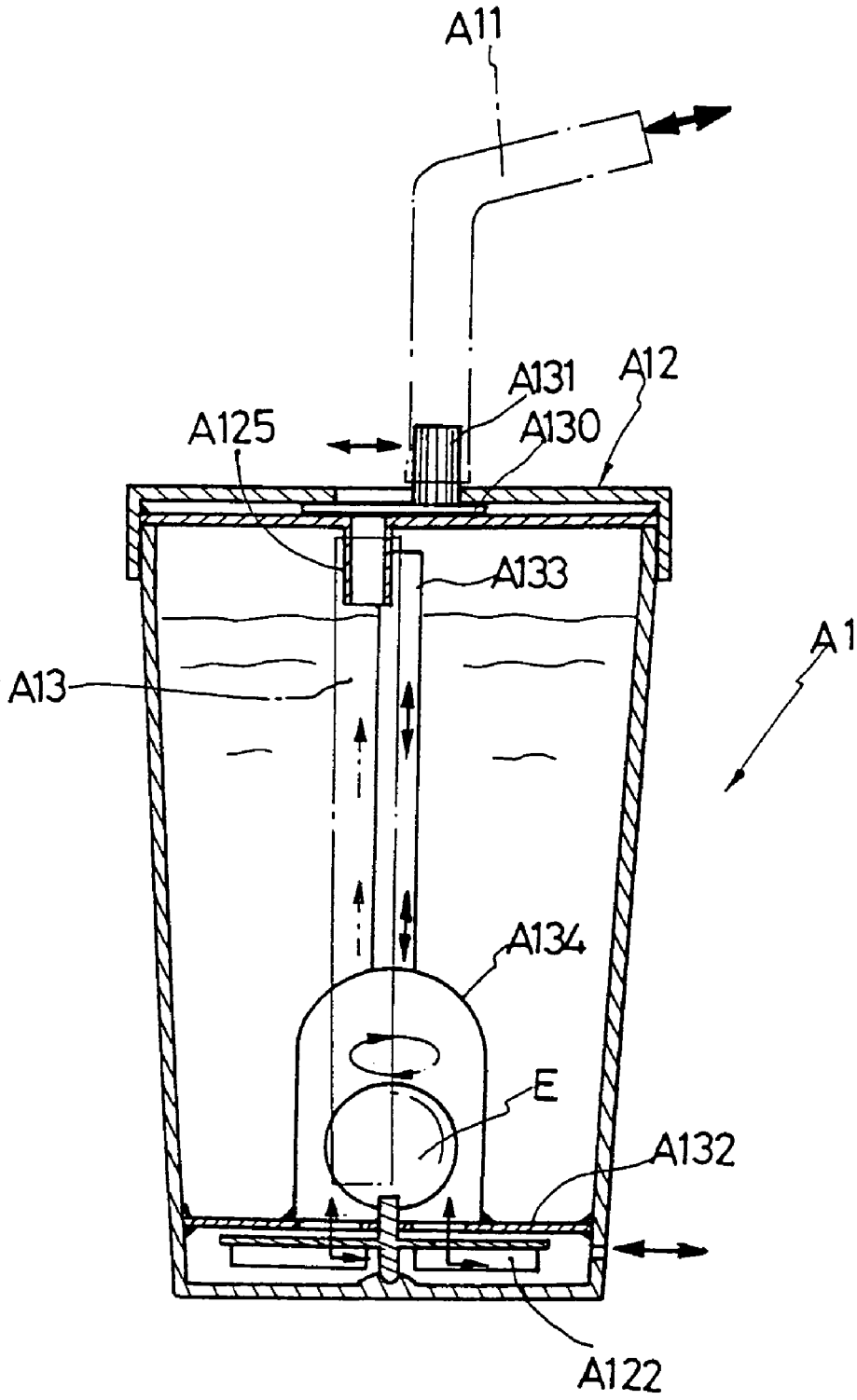
FIG. 6 is a sectional view showing a third preferred embodiment.
Figure 7:
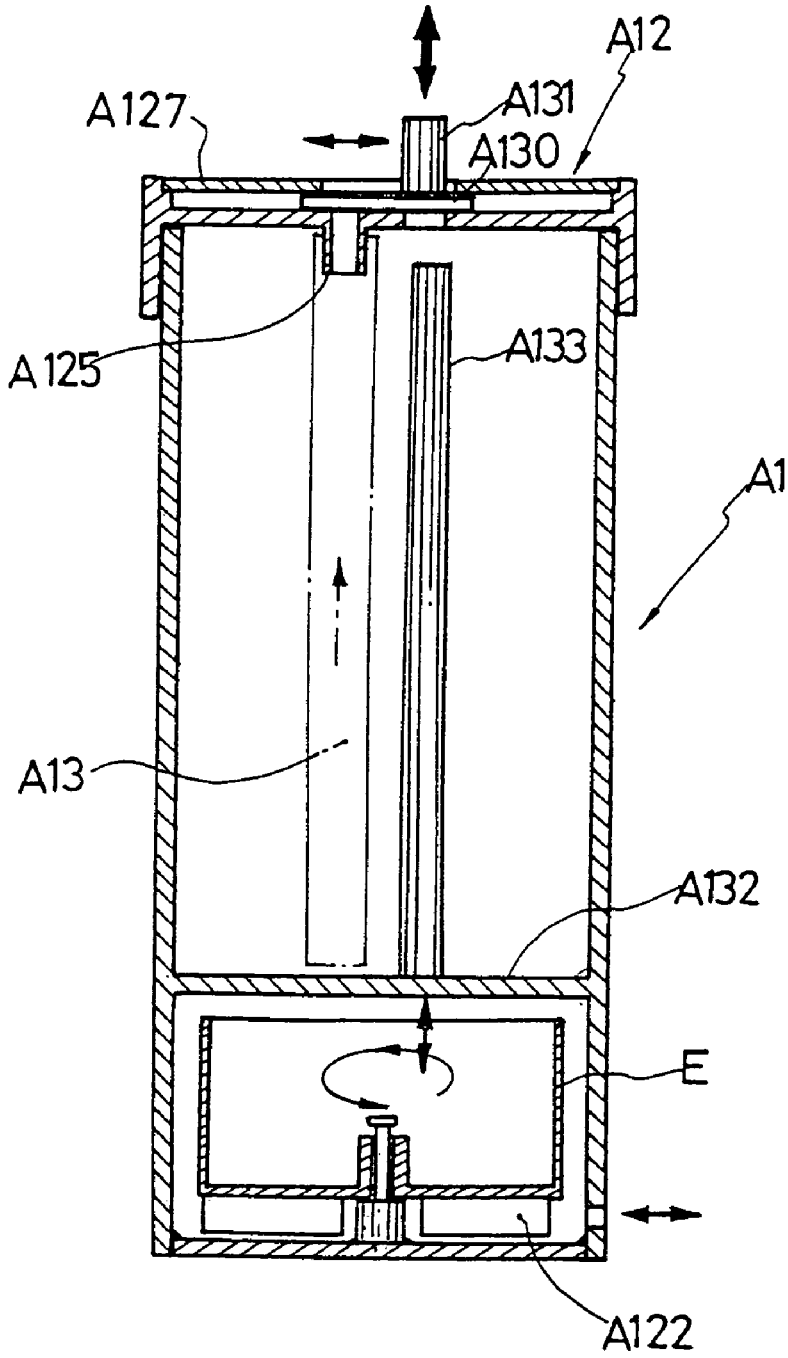
FIG. 7 is a schematic view showing the action of the third preferred embodiment.

As shown in FIGS. 6 and 7, there is shown a third preferred embodiment, the rotating wheel A122 is located at the bottom section of the cup body A14 and an isolation layer A132 isolates the rotating wheel A122.

As shown in FIG. 7, a connection tube A133 is extended to the top of the cup so as to draw air into the space to drive the rotating wheel A122. As shown in FIG. 6, the connection tube 133 has a wider section A134 which can hold the rotating wheel to drive the decorating object E.

Figure 8:
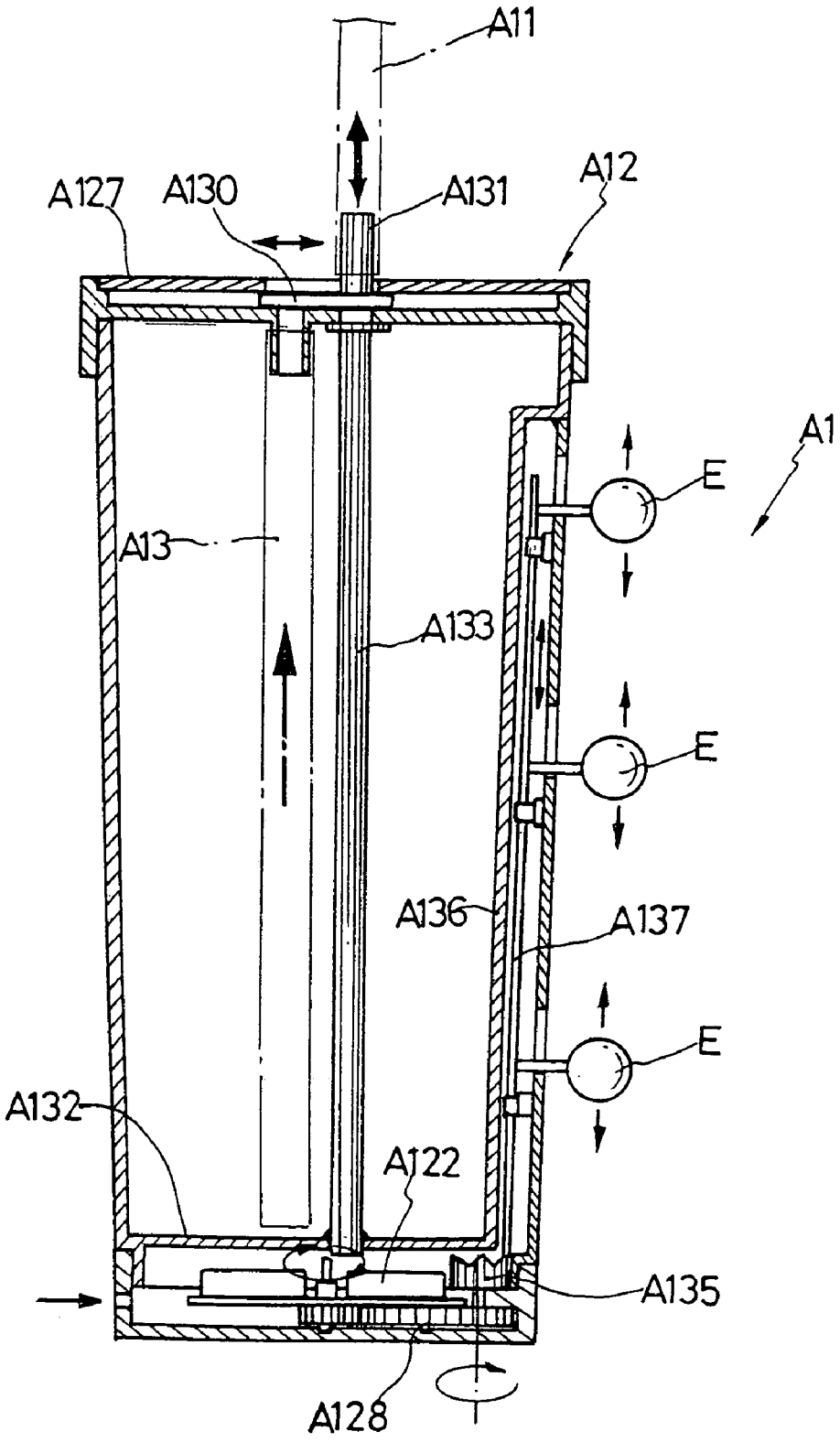
FIG. 8 is a sectional view showing the action of the fourth preferred embodiment.

As shown in FIG. 8, there is shown a fourth preferred embodiment, the rotating wheel A122 drives a transmission mechanism A128 so as to drive a protruding disc A135. The protruded disc A135 drives the linking rod A137 so that the decorating objects on the rod A137 is driven to move up and down. Thus, the cup provides an amusement effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cup structure comprising:

a cup body;

a sealing cup cap which is a dual-layered structure having a bottom layer seat and an upper layer seat arranged on said bottom layer seat, said bottom layer seat having an external edge formed with a through hole, a bottom of said upper layer seat being provided with a downwardly extending connection tube and a downwardly extending air tube, said bottom layer scat having a bottom formed with a through hole, said bottom layer seat being arranged on said cup body;

an external suction tube;

a rotating wheel fitted in said bottom layer seat;

a suction tube extending through said through hole of said bottom layer seat to connect to said connection tube;

a sealing cup cap provided with a transmission mechanism which is drivingly connected with said rotating wheel, said transmission mechanism having a plurality of axles;

a capping plate mounted on a top of said upper layer seat;

a triggering plate provided with an upwardly extending tube which extends upwardly through said capping plate to engage with said external suction tube; and a plurality of decorating objects connected with said axles.

* * * * *